US006041810A

United States Patent [19]

Dudley

[11] Patent Number: 6,041,810

[45] Date of Patent: Mar. 28, 2000

[54] REFRIGERANT CHARGING TOOL

[75] Inventor: Newton Howard Dudley, Roanoke, Tex.

[73] Assignee: Technical Chemical Company, Cleburne, Tex.

[21] Appl. No.: 09/273,598

[22] Filed: Mar. 22, 1999

[51] Int. Cl.[7] ..... F16K 43/00

[52] U.S. Cl. ..... 137/318

[58] Field of Search ..... 7/100, 132, 142, 7/158, 170; 81/2, 3.4, 3.44, 411, 414, 418, 424.5, 426.5, 423, 426; 137/318; 222/5, 81, 82, 83, 83.5, 192; 30/124, 443

[56] References Cited

U.S. PATENT DOCUMENTS

| | | | |
|---|---|---|---|
| 2,008,807 | 7/1935 | Williams . | |
| 3,147,887 | 9/1964 | Brooks . | |
| 3,252,475 | 5/1966 | Jones | 137/318 |
| 3,303,968 | 2/1967 | Compere . | |
| 3,370,752 | 2/1968 | Abler . | |
| 3,395,724 | 8/1968 | Hamel | 137/318 |
| 3,661,169 | 5/1972 | Mullins . | |
| 3,698,419 | 10/1972 | Tura | 137/318 |
| 3,920,037 | 11/1975 | Hoff et al. . | |
| 4,112,944 | 9/1978 | Williams . | |
| 4,128,918 | 12/1978 | Wenk . | |
| 4,204,559 | 5/1980 | Wagner . | |
| 4,281,775 | 8/1981 | Turner . | |
| 4,316,622 | 2/1982 | Nelson . | |
| 4,852,769 | 8/1989 | Robertson et al. . | |
| 5,105,844 | 4/1992 | King, Sr. | 137/318 |
| 5,291,914 | 3/1994 | Bares et al. | 137/318 |
| 5,301,532 | 4/1994 | Bickmore et al. | 137/318 |
| 5,373,866 | 12/1994 | Whalen, II | 137/318 |
| 5,609,181 | 3/1997 | Evans | 137/318 |
| 5,694,972 | 12/1997 | King | 137/318 |

*Primary Examiner*—George L. Walton
*Attorney, Agent, or Firm*—Konneker & Smith, P.C.

[57] ABSTRACT

A disclosed tool provides convenient use thereof. In a described embodiment, a refrigerant charging tool has two separately formed handles pivotably attached to each other. One of the handles has a container piercing member mounted thereon. A spacer is configured for attachment to the other handle, so that a relatively small container may be biased against the container piercing member when the handles are pivoted toward each other.

10 Claims, 3 Drawing Sheets

REFRIGERANT CHARGING TOOL

BACKGROUND OF THE INVENTION

The present invention relates generally to tools utilized in conjunction with refrigeration systems and, in an embodiment described herein, more particularly provides a refrigerant charging tool.

It is common practice to introduce fluid into a refrigeration system, such as an automotive air conditioning system, from a container in which the fluid is commercially packaged. For example, relatively small quantities of refrigerants such as R-12 and R-134a are typically packaged in generally cylindrical cans. A special purpose tool is commonly utilized to dispense the refrigerant or other fluid (e.g., lubricant, leak detector, seal rejuvenator, etc.) into the refrigerant system.

Many forms of these tools have been promulgated in the past, each of which typically includes a means for securing the container, a means for piercing the container, a means for sealing the pierced container, and a means for delivering the fluid from the pierced container to the refrigeration system. In one such tool, the container is secured by encircling the container within a flexible ring portion extendably attaching two handles to each other. A hollow piercing needle projects inwardly from the ring opposite a portion of the tool where the handles are squeezed together. When the handles are squeezed together, the circumference of the ring decreases, thereby forcing the container against the needle, and eventually causing the needle to puncture the container. If the container is substantially smaller than the ring (i.e., if the ring is sized for a larger container, such as a refrigerant can, as opposed to a smaller container, such as a typical oil charge can), a spacer must be utilized in the area between the container and the portion of the tool where the handles are squeezed together.

Unfortunately, such tools require a relatively large force to squeeze the handles together, due to the fact that the container presses against the portion of the tool where the handles are squeezed together, at the same time as the handles are being squeezed together. Additionally, where the spacer is utilized, the spacer must be positioned adjacent the portion of the tool where the handles are squeezed together, which positioning is relatively difficult to accomplish, and difficult to maintain while the handles are being squeezed together. Furthermore, the placement of the needle on the ring opposite the portion of the tool where the handles are squeezed together prevents convenient use of a hinged pivotable attachment between the handles at that position.

From the foregoing, it can be seen that it would be quite desirable to provide a tool which does not require the container to press against a portion of the tool being squeezed together, and which does not require, for smaller containers, that a spacer be positioned at the portion of the tool being squeezed together, but which permits enhanced convenience in utilization of the tool. It is accordingly an object of the present invention to provide such a tool.

SUMMARY OF THE INVENTION

In carrying out the principles of the present invention, in accordance with an embodiment thereof, a refrigerant charging tool is provided which is configured to permit convenient use thereof.

In broad terms, a tool is provided for use in dispensing fluid from a container into a refrigeration system. The tool includes two pivotably attached handles, a container piercing member, and a container spacer.

Each of the handles has a grip portion and a container receiving portion. The handles are separately formed from each other and are pivotably attached via a hinged connection opposite the grip portion of each handle. Each container receiving portion is generally semi-circular shaped. The handles are releasably securable in a closed position by a locking device positioned between the handle grip portions.

The container piercing member projects inwardly from one of the handle container receiving portions. The container spacer releasably attaches to one of the handle container receiving portions. The container spacer is configured to position the container laterally away from one of the handle container receiving portions and toward the container piercing member.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
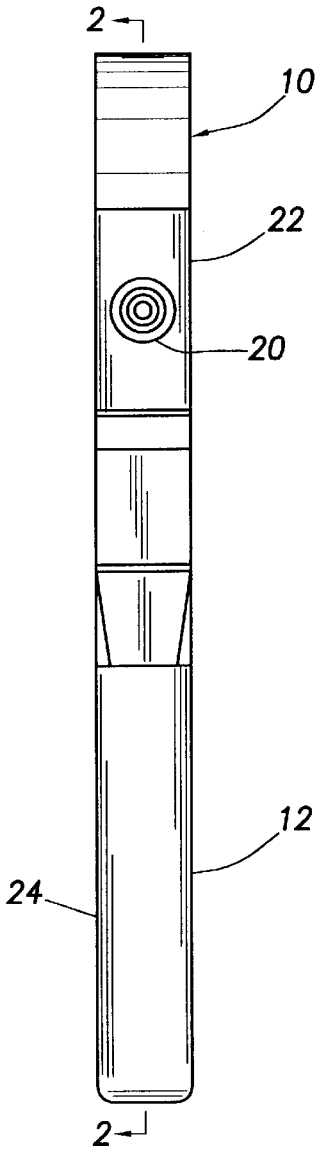
FIG. 1 is a side elevational view of a refrigerant charging tool embodying principles of the present invention.
Figure 2:
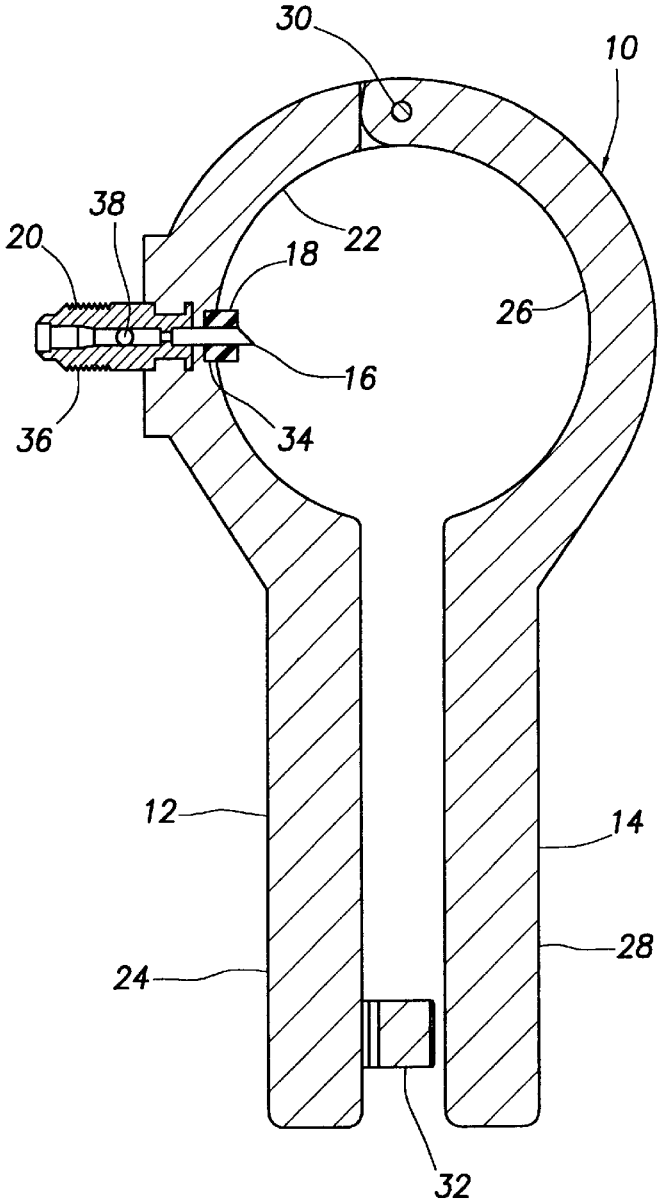
FIG. 2 is a cross-sectional view through the tool, taken along line 2—2 of FIG. 1.

Representatively illustrated in FIGS. 1 & 2 is a refrigerant charging tool 10 which embodies principles of the present invention. In the following description of the tool 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The tool 10 includes two handles 12, 14, a container piercing member 16, an annular gasket 18 surrounding the piercing member, and a fitting 20. The handle 12 has a generally semi-circular shaped container receiving portion 22 and a generally cylindrical grip portion 24. Similarly, the handle 14 includes a generally semi-circular shaped container receiving portion 26 and a generally cylindrical grip portion 28. Note that the handles 12, 14 are separately formed from each other, but are pivotably attached to each other by means of a pivot pin 30 installed through each of the handles adjacent the container receiving portions 22, 26, forming a hinged connection. A locking device 32 (only partially visible in FIG. 2, see FIG. 3) positioned between the grip portions 24, 28 releasably secures the handles 12, 14 in a closed position, as described more fully below.

The piercing member 16 is representatively illustrated as a hollow needle. Of course, other types of container piercing members could be provided. For example, it is not necessary for the piercing member 16 to be hollow, or for it to be in the shape of a needle.

The gasket 18 is retained in a recess 34 formed on an inner side surface of the container receiving portion 22. The gasket 18 preferably contacts a container (not shown in FIGS. 1 & 2, see FIG. 4) and seals between the handle 12 and the container before the container is pierced by the piercing member 16. The gasket 18 could, however, seal against the container when it is pierced, or after the container is pierced, without departing from the principles of the present invention.

The fitting 20 has a conventional externally threaded connection 36 formed thereon for interconnection of the tool 10 to a standard flexible hose used in charging refrigerant systems. A ball 38 within the fitting 20 blocks fluid flow into the container from the fitting, but permits fluid flow outwardly through the fitting. Thus, the fitting 20 also performs a check valve function. However, it is to be clearly understood that the fitting 20 could be otherwise configured, without departing from the principles of the present invention. Note that the fitting 20 is molded partially within the handle 12, eliminating the need for any separate attachment member. The piercing member 16 is press-fit into the fitting 20 from opposite side of the container receiving portion 22. Alternatively, the piercing member 16 and fitting 20 could be molded together in the handle 12, and the piercing member and fitting 20 could be integrally formed.

Figure 3:
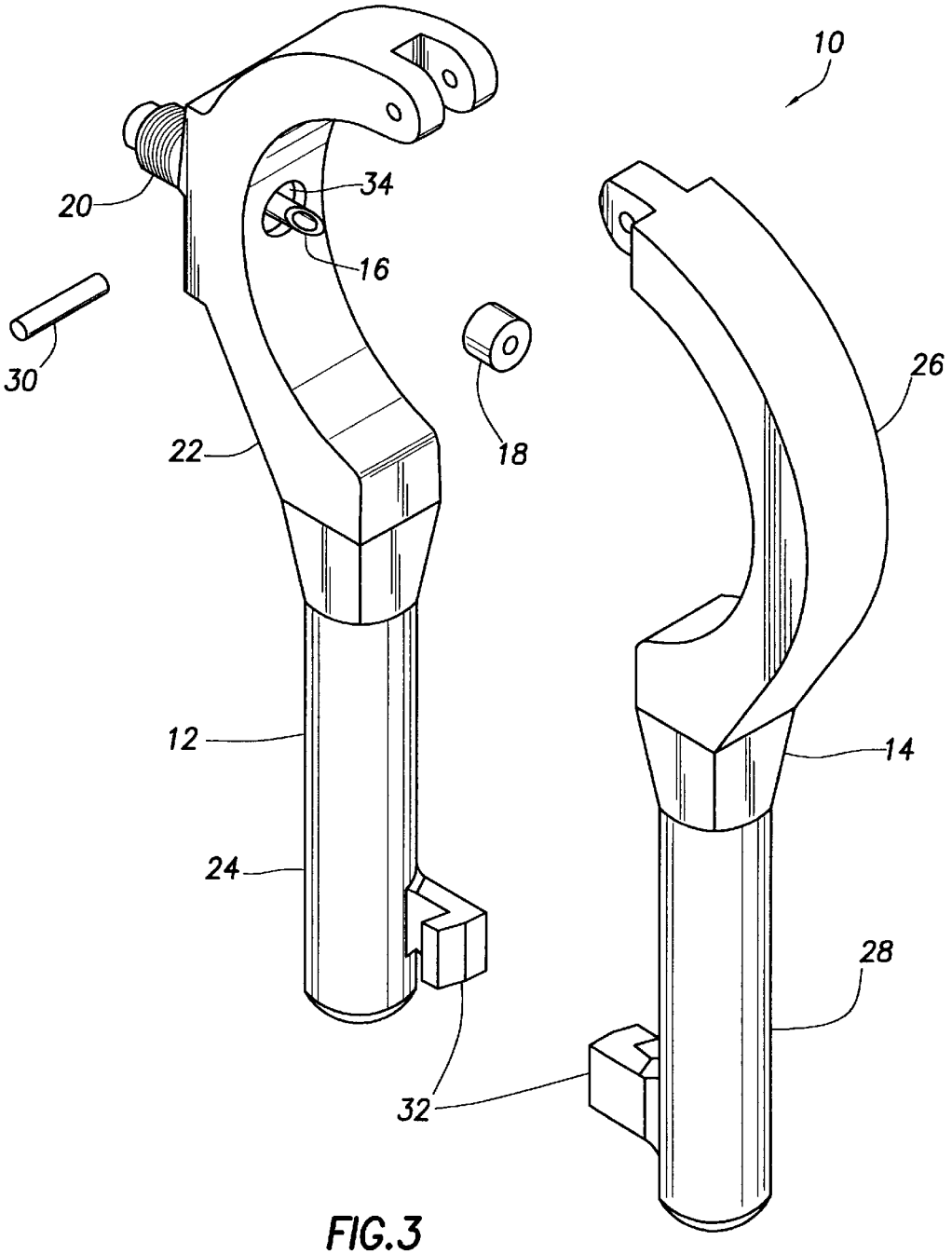
FIG. 3 is an exploded isometric view of the tool illustrating the assembly of various elements of the tool.

Referring additionally now to FIG. 3, it may be clearly seen how the tool 10 is assembled. Its construction facilitates straightforward and economical assembly, while also permitting convenient use thereof.

With the tool 10 assembled as shown in FIGS. 1 & 2, the handles 12, 14 are pivoted away from each other and a container is positioned between the container receiving portions 22, 26. The handles 12, 14 are then pivoted toward each other by biasing the grip portions 24, 28 with one or both of a person's hands. The container receiving portion 26 eventually forces the container against the piercing member 16, so that the container is pierced and the gasket 18 seals between the container and the container receiving portion 22. Fluid may now be dispensed from the container through the fitting 20 via a hose or other connector device to a refrigeration system.

Figure 4:
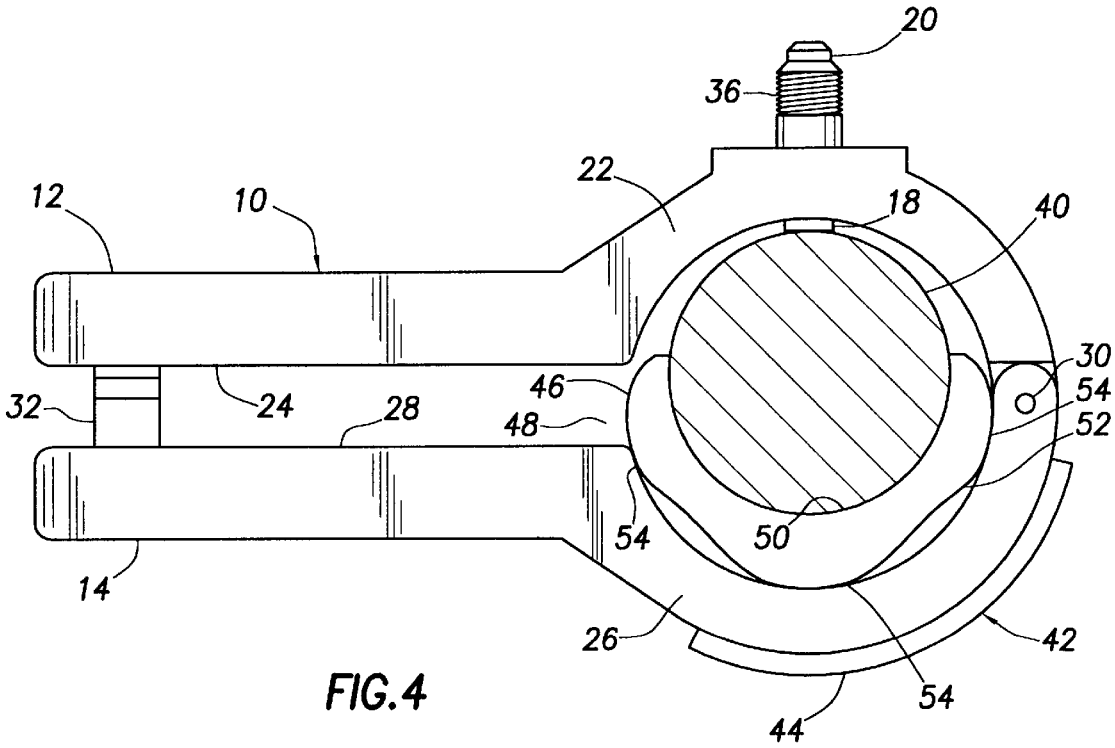
FIG. 4 is an elevational view of the tool, illustrating its use with a relatively small container and a spacer specially configured therefor.

Referring additionally to FIG. 4, the tool 10 is representatively illustrated in a closed position with a generally cylindrical container 40 positioned between the container receiving portions 22, 26. The container 40 is relatively small, that is, it is smaller than that which could otherwise be positioned between the container receiving portions 22, 26. For example, the container receiving portions 22, 26 may be sized to complementarily receive therebetween a standard small quantity R-134a refrigerant can, while the container 40 is a smaller standard refrigerant oil can.

To enable the container receiving portion 26 to bias the container 40 against the piercing member 16 and gasket 18, a spacer 42 of the tool 10 is utilized. The spacer 42 releasably attaches to the container receiving portion 26 opposite the piercing member 16 as shown in FIG. 4. The spacer 42 is illustrated apart from the remainder of the tool 10 in FIG. 5.

The spacer 42 includes a handle attachment portion 44 and a generally crescent-shaped portion 46. The attachment portion 44 partially encircles the container receiving portion 26, attaching the spacer 42 to the handle 14. Note that the spacer 42 does not need to span the space 48 between the handles 12, 14, so it is more securely attached to the handles, and a person does not have to manipulate both the handles and the spacer while piercing the container 40 therebetween.

The crescent-shaped portion 46 includes an inner side surface 50 complementarily shaped relative to the container 40, and an outer side surface 52 configured for cooperative engagement with an inner side surface of the container receiving portion 26. The outer side surface 52 has a series of spaced apart abutments 54 formed thereon, which contact the container receiving portion 26.

Figure 5:
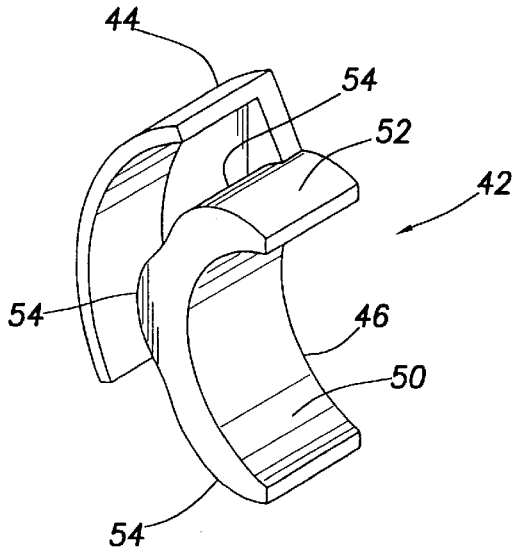
FIG. 5 is an isometric view of the spacer.

The crescent-shaped portion 46 and the attachment portion 44 together have a generally U-shaped cross-section which is clearly seen in FIG. 5. Note that, when installed on the handle 14, the container receiving portion 26 is received in the open side of the U-shaped cross-section.

The attachment portion 44 is circumferentially offset from the crescent-shaped portion 46. In this manner, the spacer 42 accommodates a variation in thickness of the container receiving portion 26.

It may now be fully appreciated that, by disposing the piercing member 16 approximately ninety degrees from the pivot pin 30 about the container receiving portion 22, piercing of the container 40 is much easier than it would be if the piercing member were disposed adjacent or at the pivot. This is due in part to the fact that, when a person displaces the handle 12 toward the other handle 14, the piercing member 16 displaces toward the container 40 in the same direction. This eliminates any friction produced by translating lateral motion of the handles 12,14 into longitudinal movement of the container 40.

Of course, a person skilled in the art would find it obvious, upon a reading of the above description of an embodiment of the invention, to make many modifications, additions, deletions, substitutions, and other changes to the described embodiment, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A tool for use in dispensing fluid from a container into a refrigerant system, the tool comprising:

first and second pivotably attached handles, each of said handles having a grip portion and a container receiving portion, the first and second handles being separately formed from each other and pivotably attached via a hinged connection opposite the grin portion of each handle, each container receiving portion being generally semi-circularly shaped, the first and second handles being releasably securable in a closed position by a locking device positioned between the first and second handle grip portions;

a container piercing member projecting inwardly from the first handle container receiving portion, the container piercing member having a fixed position relative to the first handle container receiving portion and further having a flow passage formed therethrough; and a container spacer releasably attached to the second handle container receiving portion, the container spacer being configured to position the container laterally away from the second handle container receiving portion and toward the container piercing member, the container spacer having a first section releasably engaging an inner side surface of the second handle container receiving portion, and a second section releasably engaging an opposite outer side surface of the second handle container receiving portion.

2. The tool according to claim 1, wherein the container spacer includes a handle attachment portion at least partially encircling the second handle container receiving portion, and a generally crescent-shaped portion having an inner side surface complementarily shaped relative to the container.

3. The tool according to claim 2, wherein the generally crescent-shaped portion further has an outer side surface configured for cooperative engagement with the inner side surface of the second handle container receiving portion.

4. The tool according to claim 3, wherein the generally crescent-shaped portion outer side surface has a series of spaced apart abutments formed thereon contacting the second handle container receiving portion inner side surface.

5. The tool according to claim 4, wherein the generally crescent-shaped portion and the handle attachment portion together have a generally U-shaped cross-section having an open side, the second handle container receiving portion being received in the open side.

6. The tool according to claim 5, wherein the generally crescent-shaped portion is circumferentially offset relative to the handle attachment portion.

7. The tool according to claim 1, wherein the piercing member is spaced about ninety degrees from the hinged connection about the first handle container receiving portion and is positioned opposite the second handle container receiving portion.

8. The tool according to claim 7, wherein the piercing member is molded within the first handle container receiving portion.

9. The tool according to claim 1, further including a gasket disposed about the piercing member and received in a recess formed in an inner side surface of the first handle container receiving portion.

10. A tool for dispensing fluid into a refrigeration system from a container, the tool comprising:

first and second pivotably attached handles, each of said handles having a grip portion and a container receiving portion, the first and second handles being separately formed from each other and pivotably attached to each other via a hinged connection joining the container receiving portions to each other, each container receiving portion being generally semi-circular shaped, the first and second handles being releasably securable in a closed position by a locking device positioned between the first and second handle grip portions;

a container piercing member molded within and projecting inwardly from the first handle container receiving portion, the piercing member being positioned between the hinged connection and the first handle grip portion, and positioned opposite the second handle container receiving portion;

a gasket disposed about the piercing member and received in a recess formed in an inner side surface of the first handle container receiving portion; and a container spacer releasably attached to the second handle container receiving portion, the container spacer being configured to position the container laterally away from the second handle container receiving portion and toward the piercing member, the container spacer including a handle attachment portion at least partially encircling the second handle container receiving portion, and a generally crescent-shaped portion circumferentially offset relative to the handle attachment portion, the generally crescent-shaped portion having an inner side surface complementarily shaped relative to the container, an outer side surface configured for cooperative engagement with an inner side surface of the second handle container receiving portion, and the generally crescent-shaped portion outer side surface having a series of spaced apart abutments formed thereon contacting the second handle container receiving portion inner side surface, the generally crescent-shaped portion and the handle attachment portion together having a generally U-shaped cross-section with an open side, the second handle container receiving portion being received in the open side.

* * * * *